US011114078B2

(12) United States Patent
Zhou et al.

(10) Patent No.: US 11,114,078 B2
(45) Date of Patent: Sep. 7, 2021

(54) KEYBED DEVICE

(71) Applicants: Medeli Electronics (Shanghai) Co., Ltd., Shanghai (CN); MEDELI MUSICAL INSTRUMENT (ZHUHAI) CO., LTD., Guangdong (CN)

(72) Inventors: Peng Zhou, Shanghai (CN); Jiejun Chen, Shanghai (CN); Xinghua Ge, Shanghai (CN); Guozong Liu, Shanghai (CN)

(73) Assignee: Medeli Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 17/027,729

(22) Filed: Sep. 22, 2020

(65) Prior Publication Data

US 2021/0005174 A1 Jan. 7, 2021

Related U.S. Application Data

(63) Continuation-in-part of application No. PCT/CN2019/114715, filed on Oct. 31, 2019.

(51) Int. Cl.
*G10H 1/34* (2006.01)
*G10C 3/12* (2006.01)

(52) U.S. Cl.
CPC ..... *G10H 1/346* (2013.01); *G10C 3/125* (2013.01)

(58) Field of Classification Search
CPC ..... G10H 1/346; G10C 3/125
See application file for complete search history.

(56) References Cited

U.S. PATENT DOCUMENTS

| | | | | | |
|---|---|---|---|---|---|
| 5,696,340 | A * | 12/1997 | Ragni | G10H 1/346 | 84/423 R |
| 5,821,443 | A * | 10/1998 | Masubushi | G10H 1/346 | 84/433 |
| 7,176,370 | B2 * | 2/2007 | Osuga | G10C 3/12 | 84/423 R |
| 7,678,981 | B2 * | 3/2010 | Toyama | G10H 1/344 | 84/439 |
| 9,040,807 | B2 * | 5/2015 | Osuga | G10H 1/346 | 84/744 |
| 9,269,336 | B2 * | 2/2016 | Osuga | G10C 3/12 | |
| 9,281,142 | B2 * | 3/2016 | Sawada | G10H 1/346 | |
| 9,424,825 | B2 * | 8/2016 | Osuga | G10H 1/34 | |
| 9,583,086 | B2 * | 2/2017 | Takata | G10H 1/346 | |
| 10,891,929 | B2 * | 1/2021 | Yamamoto | G10H 1/053 | |
| 2021/0005174 | A1 * | 1/2021 | Zhou | G10C 3/125 | |

* cited by examiner

*Primary Examiner* — Robert W Horn

(57) ABSTRACT

The present disclosure proposes a keybed device, including: a keybed support; a keybed arranged on the keybed support; a key height limiting column arranged in one-to-one correspondence with each key in the keybed, and an end of the key height limiting column is fixed on a bottom surface of the corresponding key; a pressure detecting device arranged in one-to-one correspondence under each key height limiting column to detect a pressing strength of each key height limiting column; and a flexible support structure arranged below each key height limiting column and located on at least one side of each pressure detection device. The keybed device includes a flexible support structure, which can avoid false triggering of the Aftertouch effect. A same depth is pressed down from the flexible support structure to obtain a consistent Aftertouch effect, and the performance effect is controllable.

16 Claims, 13 Drawing Sheets

KEYBED DEVICE

CROSS REFERENCE TO RELATED APPLICATION

This is a continuation-in-part application claiming priority to a pending PCT application PCT/CN2019/114715, filed on Oct. 31, 2019, which claims the priority to a Chinese application No. 2019206421553, filed on May 7, 2019, both of which are hereby incorporated by reference in their entireties, including any appendices or attachments thereof, for all purpose.

BACKGROUND

Field of Disclosure

The present disclosure relates to the field of electronic musical instruments, in particular to a keybed device.

Description of Related Arts

With the development of digital technology, the computing and processing capabilities of processors are getting stronger. Electronic musical instruments can create many effects and timbres. These effects cannot be well interpreted and deduced by the performance tools of traditional musical instruments.

On the basis of simulating traditional musical instruments such as pianos and organs, electronic musical instrument products achieve performance effects that traditional musical instruments cannot accomplish by using pressure or inductance sensor detection, such as the Aftertouch function of the keybed. However, the Aftertouch function of existing electronic keybeds is all monophonic (MONO). As shown in FIG. 1, the entire keybed (such as 49 keys) has only one resistance sensor, and all keys share one Aftertouch sensor (resistance sensor). When playing, it can only show the Aftertouch effect of one key at the same time, which is monotonous and cannot well interpret the player's emotions. There are also keybeds in the prior art that use the principle of inductance and electromagnetic detection to achieve a Poly Aftertouch effect. As shown in FIG. 2, each key corresponds to an Aftertouch sensor, and each sensor is independent and can work independently. However, this keybed device is expensive, the production process is complicated, and the keybed device requires multiple calibrations, which has not been popularized in some popular electronic musical instruments.

For Poly Aftertouch devices, where each key corresponds to an Aftertouch sensor, it is particularly important to maintain consistency. At present, in the existing keybed device with Aftertouch, the keys are limited by the limit lint on the keybed support. After the keys are pressed down to contact the limit lint, more pressure is applied to the keys, and the limit lint will be deformed until it can sense the sensor circuit board to produce an Aftertouch effect. Since the flatness of the keybed cannot be guaranteed to be absolutely flat, the sensor circuit board cannot be absolutely flat, and the sensor on the circuit board will also have high and low differences. Therefore, the two components that will be sensed have the defects of hidden quality problems, resulting in inconsistent Aftertouch pressure and Aftertouch performance effects for each key. For example, two keys of A and B have different heights, the A key is high, and the B key is low, when the A key and the B key are pressed at the same depth, the A key just hits the sensor surface and the output signal amplitude is AA, and the B key presses the sensor down so that the output signal amplitude is BB, and the value of AA is obviously smaller than the value of BB. That is, due to the uneven surface of the keybed, the users feel that the depths they press are the same, but the output signals (Aftertouch pressure value) are different, and the produced sound effects are also different. When multiple keys are played together, the user cannot control the performance well.

Electronic keybeds usually require a large pressing force to trigger the Aftertouch function of the keybed, and the white and black keys usually require different pressures to trigger Aftertouch, resulting in the player's inability to control the pressing force well, which brings inconvenience to the performance. The sensitivity of Aftertouch is poor, resulting in a poor feel when the keys hit the bottom, noise will be generated after the keys hit the bottom, and the performance is poor.

Therefore, it has become one of the problems to be solved by those skilled in the art to propose a pressure sensing technology with low cost and a consistent Aftertouch effect to achieve a Poly Aftertouch effect.

SUMMARY OF THE PRESENT DISCLOSURE

The present disclosure provides a keybed device to solve the problems of inconsistent Aftertouch effects and high cost in the prior art.

The present disclosure proposes a keybed device. The keybed device includes: a keybed support, a keybed, a key height limiting column, a pressure detection device, and a flexible support structure. The keybed is arranged on the keybed support. The key height limiting column is arranged in one-to-one correspondence with each key in the keybed, and an end of the key height limiting column is fixed on a bottom surface of the corresponding key. The pressure detecting device is arranged in one-to-one correspondence under each key height limiting column to detect a pressing strength of each key height limiting column. The flexible support structure is arranged below each key height limiting column and located on at least one side of each pressure detection device.

More optionally, the pressure detection device includes a pressure sensing unit and a piezoresistor sensor located below the pressure sensing unit.

More optionally, the pressure sensing unit includes a sensing component, a connecting component, and a sensor fixing component; the connecting component is arranged on a side surface of the sensing component, and the sensor fixing component is arranged on a bottom surface of the connecting component to fix the piezoresistive sensor.

More optionally, the sensing component includes: a top recess formed in a top surface of the sensing component; and a first exhaust slot formed in the top surface of the sensing component and extending from the top recess to a side surface of the sensing component.

More optionally, the first exhaust slot extends in a direction perpendicular to the side surface of the sensing component.

More optionally, a shape of the top recess includes a square, and the sensing component includes two first exhaust slots corresponding to each edge of the square.

More optionally, the connecting component includes a second exhaust slot formed on a bottom surface of the connecting component, which extends from the sensing component to a side surface of the connecting component or connects two adjacent sensing components.

More optionally, a bottom surface of the pressure sensing unit is a curved surface.

More optionally, a material of the pressure sensing unit includes conductive silica gel or a flexible material coated with a conductive film on a bottom surface.

More optionally, the piezoresistor sensor includes a first electrode and a second electrode insulated from each other, and the first electrode and the second electrode form an interdigital structure.

More optionally, the flexible support structure includes: white key support bars respectively arranged on both sides of the pressure detection device corresponding to white keys in the keybed for supporting the white keys; and black key support bars respectively arranged on both sides of the pressure detection device corresponding to black keys in the keybed for supporting the black keys.

More optionally, a first groove is arranged on a top surface of the white key support bar, and a second groove is arranged on a top surface of the black key support bar.

More optionally, a length of the second groove is longer than a length of the first groove.

More optionally, the flexible support structure further includes a reinforcing rib arranged between adjacent white key support bar and black key support bar to connect the white key support bar with the black key support bar.

More optionally, a top surface of the flexible support structure is not lower than a top surface of the sensing component.

More optionally, a height difference between the top surface of the flexible support structure and the top surface of the sensing component is 0.3 mm.

As described above, the keybed device of the present disclosure has the following beneficial effects:

1. The keybed device of the present disclosure includes a flexible support structure, which can avoid false triggering of the Aftertouch effect. A same depth is pressed down from the flexible support structure to obtain a consistent Aftertouch effect, and the performance effect is controllable.

2. The keybed device of the present disclosure adopts a piezoresistor sensor to detect Aftertouch and Aftertouch strength, and the cost is low.

3. Each key has its own independent Aftertouch sensing structure, that is, the keybed device of the present disclosure can realize the technical effect that the keys are not affected by each other.

4. The flexible support structure in the keybed device of the present disclosure can support the keys very stably, which not only gives the keys a soft bottoming feeling, but also prevents the keys from shaking laterally, and ensures the stability of the Aftertouch function of the keys.

5. The keybed device of the present disclosure includes a top recess and a first exhaust slot, which can prevent that the air between the key and the pressure sensing unit is evacuated when the key is strongly pressed and released, resulting in the key is sucked by the pressure sensing unit and cannot be quickly returned. At the same time, it can effectively improve the sensitivity of Aftertouch and the bottoming feel, making the performance of Aftertouch richer, and avoiding the noise generated by hard bottoming.

6. The keybed device of the present disclosure includes grooves of different lengths on the white key support bar and the black key support bar, so that the supporting part corresponding to the white key is longer than the supporting part corresponding to the black key, that is, the arm of the white key is longer than that of the black key. It can be realized that the white keys and the black keys trigger Aftertouch under the same pressure, so as to adjust the trigger strength of Aftertouch, so that the Aftertouch can be triggered with light pressure during the playing process.

7. A reinforcing rib is placed between adjacent white key support bar and black key support bar, which prevents the white key support bar and the black key support bar on both sides of the pressure sensing unit from being overwhelmed when the key is strongly pressed against the pressure sensing unit.

BRIEF DESCRIPTION OF THE DRAWINGS

The foregoing and other features of the present disclosure will become more fully apparent from the following description and appended claims, taken in conjunction with the accompanying drawings. These drawings depict only several embodiments in accordance with the disclosure and are, therefore, not to be considered limiting of its scope. The disclosure will be described with additional specificity and detail through use of the accompanying drawings.

DESCRIPTION OF COMPONENT MARK NUMBERS

Figure 1:
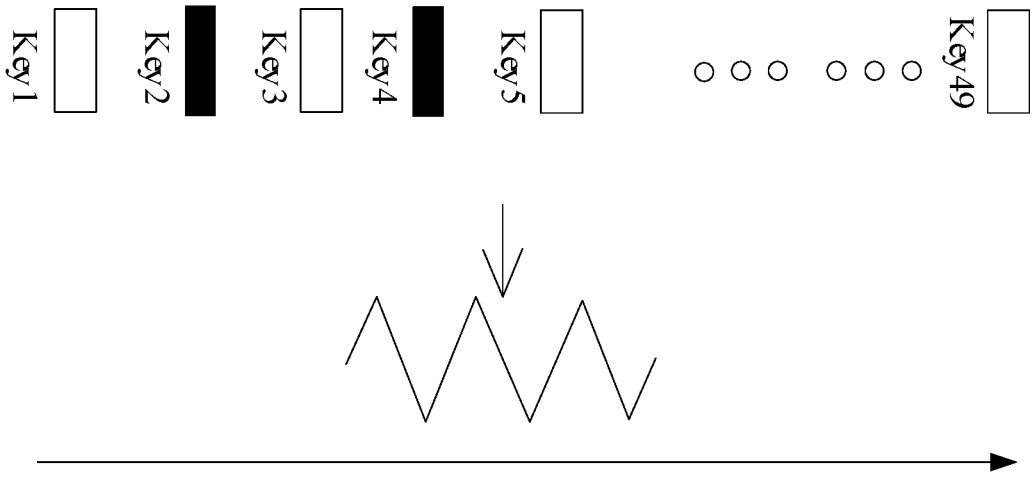
Fig. 1 (Prior Art)
FIG. 1 shows a schematic view of an Aftertouch keybed in the prior art.
Figure 2:
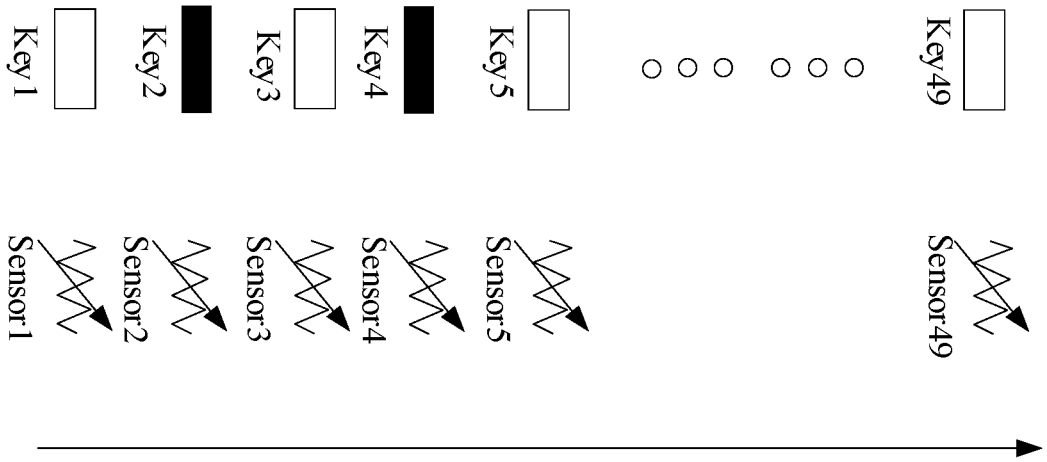
Fig. 2 (Prior Art)
FIG. 2 shows a schematic view of another Aftertouch keybed in the prior art.

1 Keybed device
11 Keybed support
121 White key
122 Black key
13 Key height limit column
14 Pressure detection device
141 Pressure sensing unit
141*a* Sensing component
141*b* Connecting component
141*c* Sensor fixing component
142 Piezoresistor sensor
142*a* First electrode
142*b* Second electrode
15 Flexible support structure
151 White key support bar
152 Black key support bar
161 First trigger member
162 Second trigger member
17 Key scanning circuit
18 Limit felt
19 Top recess
20 First exhaust slot
21 Second exhaust slot
21 Reinforcing rib

DETAILED DESCRIPTION OF THE PREFERRED EMBODIMENTS

The embodiments of the present disclosure will be described below. Those skilled can easily understand other advantages and effects of the present disclosure according to contents disclosed by the specification. The present disclosure can also be implemented or applied through other different specific embodiments. Various modifications or changes can also be made to all details in the specification based on different points of view and applications without departing from the spirit of the present disclosure.

It needs to be stated that the drawings provided in the following embodiments are just used for schematically describing the basic concept of the present disclosure, thus only illustrating components only related to the present disclosure and are not drawn according to the numbers, shapes and sizes of components during actual implementation, the configuration, number and scale of each component during actual implementation thereof may be freely changed, and the component layout configuration thereof may be more complicated.

Embodiment 1

Figure 3:
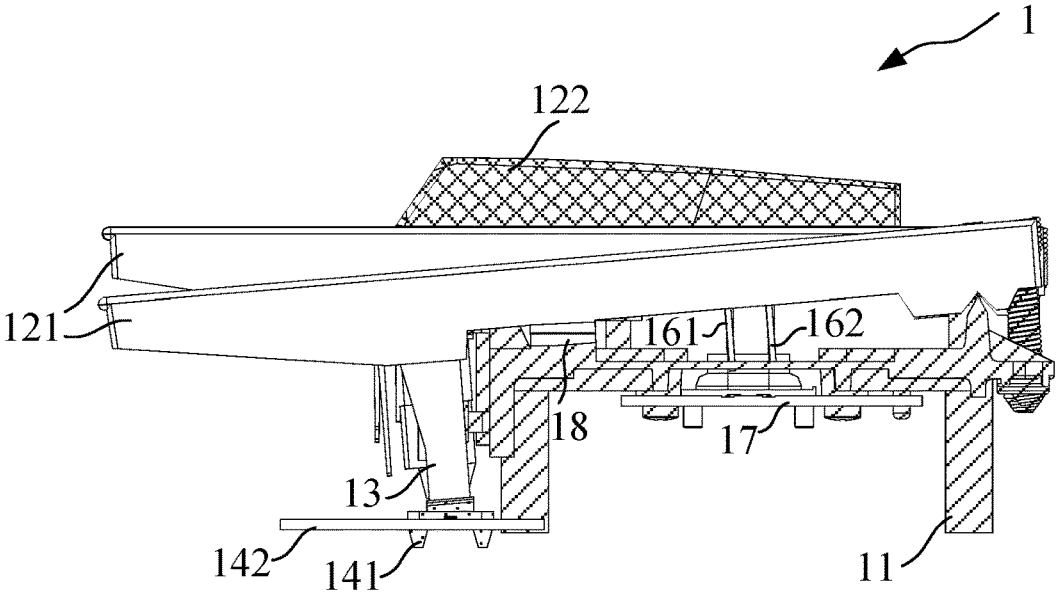
FIG. 3 shows a schematic view of a keybed device according to the present disclosure.
Figure 4:
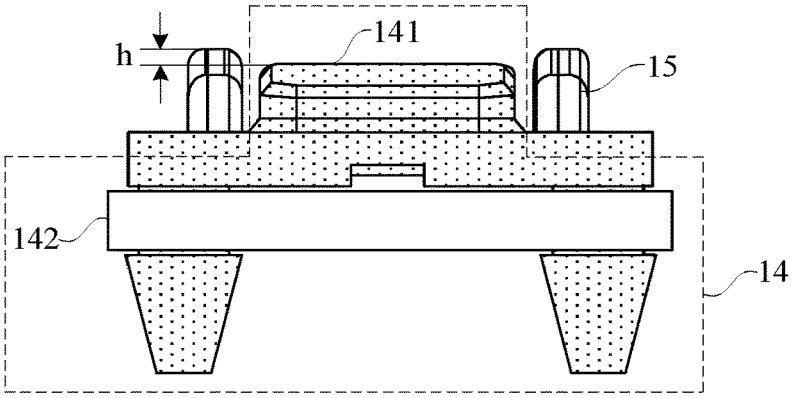
FIG. 4 shows a schematic front view of a pressure detection device and a flexible support structure according to the present disclosure.

As shown in FIGS. 3 to 4, the present disclosure provides a keybed device 1. The keybed device 1 includes: a keybed support 11, a keybed, a key height limiting column 13, a pressure detection device 14 and a flexible support structure 15.

As shown in FIG. 3, the keybed support 11 is located below the keybed to support and fix the keybed. The keybed is arranged on the keybed support 11.

Specifically, the keybed includes a plurality of white keys 121 and a plurality of black keys 122, and the white keys 121 and the black keys 122 are arranged alternately. The keybed usually includes 49, 61, or 88 keys, and the distribution of the keys will not be described here. In this embodiment, one end of each key is connected with the keybed support 11 through a spring, and the other end extends out of the keybed support 11.

As shown in FIG. 3, the key height limiting column 13 is arranged in a one-to-one correspondence with each key in the keybed, and one end of the key height limiting column 13 is fixed on a bottom surface of the corresponding key.

Specifically, the key height limiting column 13 is arranged on the bottom surface of the key. In this embodiment, the key height limiting column 13 is located on the bottom surface of the part where the key extends out of the keybed support 11. In practical applications, the key height limiting column 13 can be arranged on the bottom surface of any position of the key, as long as the key height limiting column 13 can follow the movement of the corresponding key. In this embodiment, the key height limiting column 13 is arranged perpendicular to the key. In actual use, it is not limited to this embodiment.

As shown in FIG. 3, the pressure detecting device 14 is arranged under each key height limiting column 13 in a one-to-one correspondence to detect the downward pressure of each key height limiting column 13.

Specifically, the pressure detecting device 14 is located below the key height limiting column 13, when the key is pressed down, the key height limiting column 13 follows the key to be pressed down. After the key height limiting column 13 contacts the pressure detection device 14, the pressure detection device 14 obtains the pressure information of the key height limitation column 13 based on the pressed depth of the key height limitation column 13, and converts it into an electrical signal.

Figure 5:
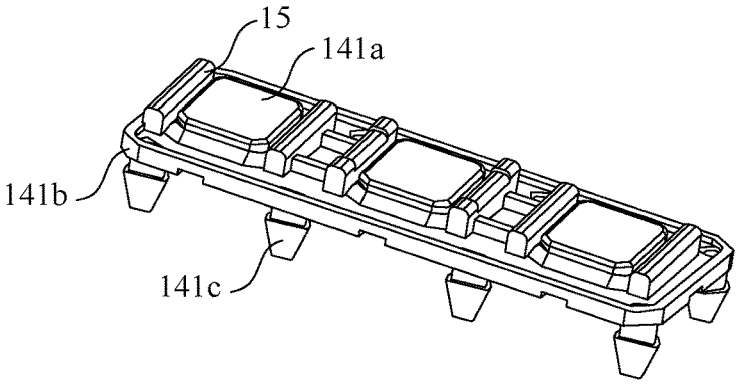
FIG. 5 shows a schematic perspective view of the pressure detection device and the flexible support structure according to the present disclosure.
Figure 6:
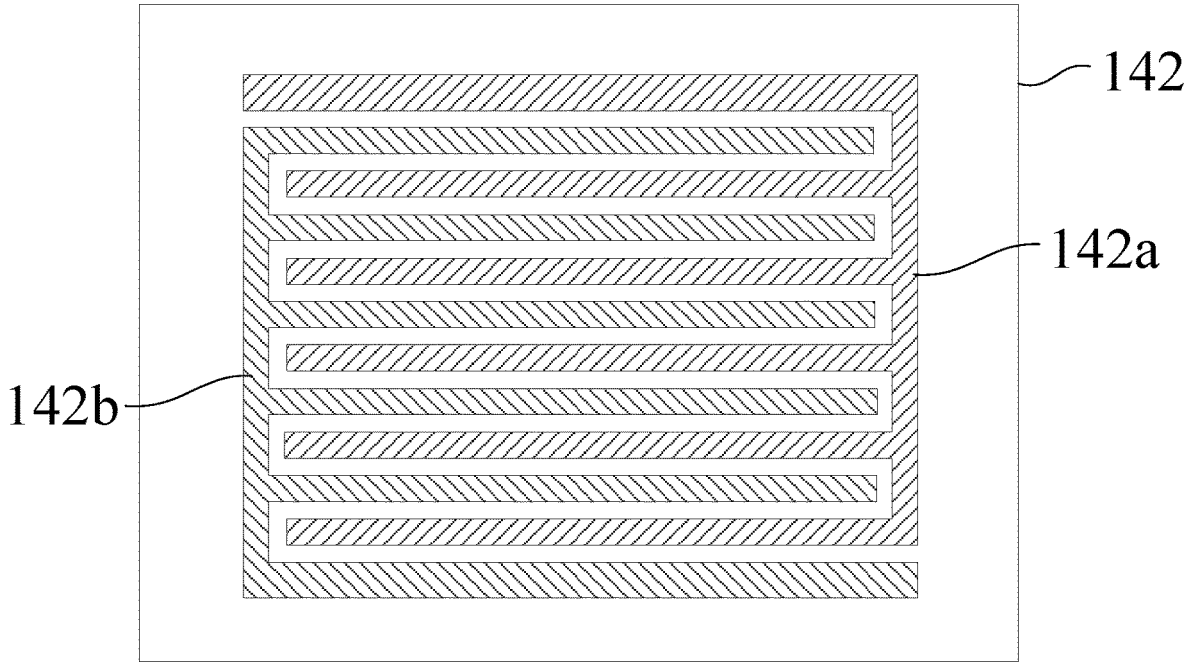
FIG. 6 shows a schematic view of a piezoresistive sensor according to the present disclosure.

As an implementation of this embodiment, as shown in FIGS. 3 and 4, the pressure detection device 14 includes a pressure sensing unit 141 and a piezoresistor sensor 142 located below the pressure sensing unit 141. A material of the pressure sensing unit 141 includes, but is not limited to, conductive silica gel or a flexible material coated with a conductive film on the lower surface. Any material that can deform under pressure and is conductive at the bottom is suitable for the present disclosure. As shown in FIG. 5, in this embodiment, each pressure sensing unit 141 includes a sensing component 141*a*, a connecting component 141*b*, and a sensor fixing component 141*c*. Each pressure sensing unit 141 is a whole (for clarity, only three pressure sensing units 141 are shown in the figure). As shown in FIGS. 4 and 5, the top and bottom surfaces of the sensing component 141*a* are flat surfaces, the connecting component 141*b* surrounds the sensing component 141*a*, and the sensor fixing component 141*c* is disposed at the bottom surface of the connecting component 141*b* to fix the circuit board where the piezoresistor sensor is located. When the top surface of the pressure sensing unit 141 is subjected to pressure, the pressure sensing unit 141 is deformed. When the pressing force is large, the lower surface of the pressure sensing unit 141 contacts the top surface of the piezoresistor sensor 142, and a corresponding electrical signal is generated. More specifically, as shown in FIG. 6, in this embodiment, the piezoresistor sensor 142 includes a first electrode 142*a* and a second electrode 142*b* that are insulated from each other, and the first electrode 142*a* and the second electrode 142*b* form an interdigital structure. Normally, the first electrode 142*a* and the second electrode 142*b* are in an open state. The surfaces of the first electrode 142*a* and the second electrode 142*b* are both arranged with conductive films. When any two points on the two electrodes are in contact, the two electrodes will be connected, a corresponding resistance will be generated, and then a corresponding detection signal will be obtained. In this embodiment, the piezoresistor sensors 142 are formed on the same circuit board, which will not be repeated here.

It should be noted that any device that can realize pressure detection is applicable to the present disclosure and is not limited to this embodiment.

As shown in FIGS. 3 to 5, the flexible support structure 15 is arranged below each key height limiting column 13 and is located at the periphery of each pressure detection device 14 respectively.

Specifically, in this embodiment, the flexible support structures 15 are located on both sides of each pressure detection device 14, and a material of the flexible support structure 15 includes but is not limited to silica gel. The flexible support structure 15 and the pressure sensing unit 141 may be integrally formed. As an implementation of this embodiment, the top surface of the flexible support structure 15 is not lower than the top surface of the sensing component 141*a*. The height difference between the top surface of the flexible support structure 15 and the top surface of the sensing component 141*a* is h.

In this embodiment, the height difference h between the top surface of the flexible support structure 15 and the top surface of the sensing component 141*a* is set to be 0.1-0.5 mm, preferably 0.3 mm. With the press of the key height limiting column 13, when the key height limiting column 13 contacts the flexible support structure 15, it indicates that Aftertouch is activated. When the bottom surface of the sensing component 141*a* contacts the top surface of the piezoresistor sensor 142, it starts to output an Aftertouch pressure detection signal.

It should be noted that in practical applications, the top surface of the flexible support structure 15 may also be lower than the top surface of the sensing component 141*a*. As the key height limiting column 13 is pressed down, when the top surface of the sensing component 141*a* contacts the top surface of the piezoresistor sensor 142, the piezoresistor sensor 142 starts to output a signal. When the key height limiting column 13 contacts the flexible support structure 15, it indicates that Aftertouch is activated, and the output signal corresponding to the piezoresistor sensor 142 is used as a starting point of the Aftertouch pressure detection signal. The pressure value obtained between the pressing depth from the top surface of the sensing component 141*a* to the top surface of the flexible support structure 15 is taken as the pre-pressure value, and is not counted as the Aftertouch pressure value.

As shown in FIG. 3, the keybed device 1 further includes a first trigger member 161 with one end fixed to the bottom surface of the key. In this embodiment, the first trigger member 161 is disposed between the key height limiting column 13 and the spring (connecting the key and the keybed support). The first trigger member 161 is perpendicular to the key. A key scanning circuit 17 is arranged under the first trigger member 161. After a key is pressed for a first set depth, the first trigger member 161 turns on the corresponding switch in the key scanning circuit 17 to obtain a first detection signal, thereby obtaining the triggering time information of the corresponding key.

As shown in FIG. 3, the keybed device 1 further includes a second trigger member 162 with one end fixed to the bottom surface of the key. In this embodiment, the second trigger member 162 is disposed between the key height limiting column 13 and the spring (connecting the key and the keybed support). The second trigger member 162 and the first trigger member 161 are arranged along the length of the key. The second trigger member 162 is perpendicular to the key. The second trigger member 162 is located above the key scanning circuit 17. After the key is pressed for a second set depth, the second trigger member 162 turns on the corresponding switch in the key scanning circuit 17 to obtain a second detection signal, thereby obtaining the triggering strength information of the corresponding key.

Figure 7:
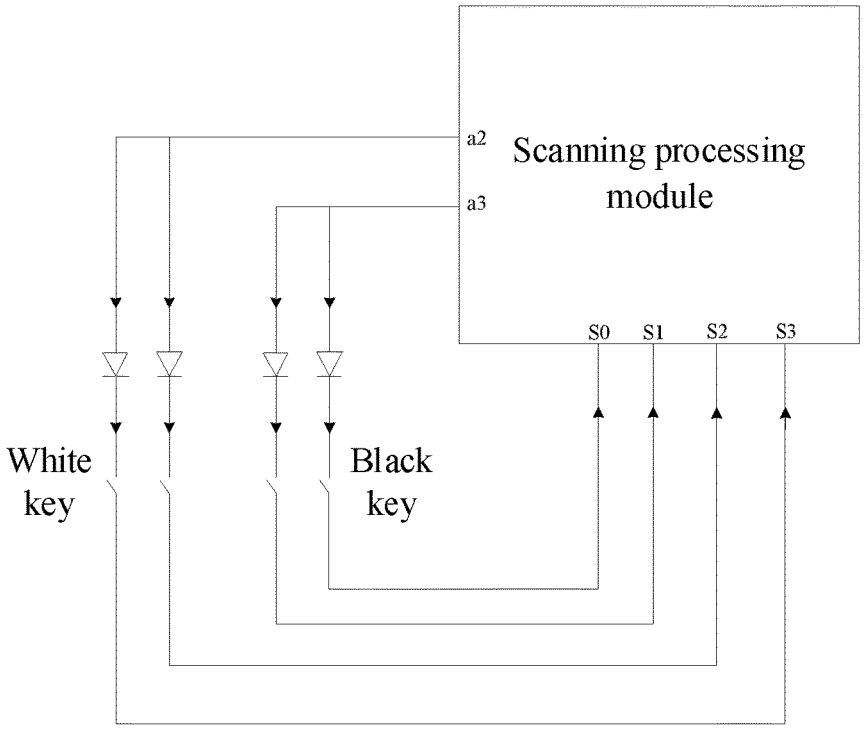
FIG. 7 shows a schematic view of a key scanning circuit according to the present disclosure.

Specifically, the key scanning circuit 17 is responsible for detecting the triggering time and the triggering strength of the keys. The key scanning circuit 17 is arranged with many switches for detecting the pressing and releasing of the keys, and each key corresponds to two switches. The pressing of the key and the pressing force can be measured by detecting the different trigger times of the two switches. As shown in FIG. 7, the key scanning circuit 17 includes a scanning processing module, switches corresponding to each trigger component, and diodes connected in series with each switch. Each key corresponds to two switches. When the switch corresponding to the key is turned on, the scanning processing module obtains a detection signal. The triggering time and triggering strength information of the corresponding key are obtained by processing two detection signals corresponding to the same key. In FIG. 7, to facilitate the display, only one white key and one black key are marked, and the connection relationships of the key scanning circuits corresponding to other keys are similar, which will not be repeated here.

As shown in FIG. 3, the keybed device 1 further includes a limit felt 18 arranged between each key and the keybed support 11 to reduce the left and right shaking of the keys and ensure the Aftertouch stability of the keys. In this embodiment, the limit felt 18 is arranged between the key height limiting column 13 and the first trigger member 161. In actual use, the limit felt 18 can be set to an appropriate position according to needs, which is not limited to this embodiment.

The working principle of the keybed device 1 of this embodiment is as follows:

When a key is pressed, the first trigger member 161 and the second trigger member 162 are first triggered, and the key scanning circuit 17 determines the effective triggering and triggering strength of the key according to the triggering and triggering time of the two corresponding switches. As the key continues to be pressed down, when the key height limiting column 13 touches the flexible support structure 15, the player perceives that the key is pressed down and pauses. If the key continues to be pressed down, it means to start Aftertouch. The pressure sensing unit 141 is deformed as the height limiting column 13 is pressed down. When the bottom surface of the sensing component 141*a* in the pressure sensing unit 141 contacts the piezoresistor sensor 142, the two electrodes in the piezoresistor sensor 142 are conducted through the bottom surface of the sensing component 141*a* to generate a corresponding electrical signal, thereby triggering the Aftertouch effect. Since the relative height of the flexible support structure 15 and the pressure sensing unit 141 is constant, the depths (the relative height of the flexible support structure 15 and the pressure sensing unit 141) of Aftertouch pressing corresponding to the keys are the same, the Aftertouch effects of the keys corresponding to the same playing strength are also consistent.

Embodiment 2

Figure 8:
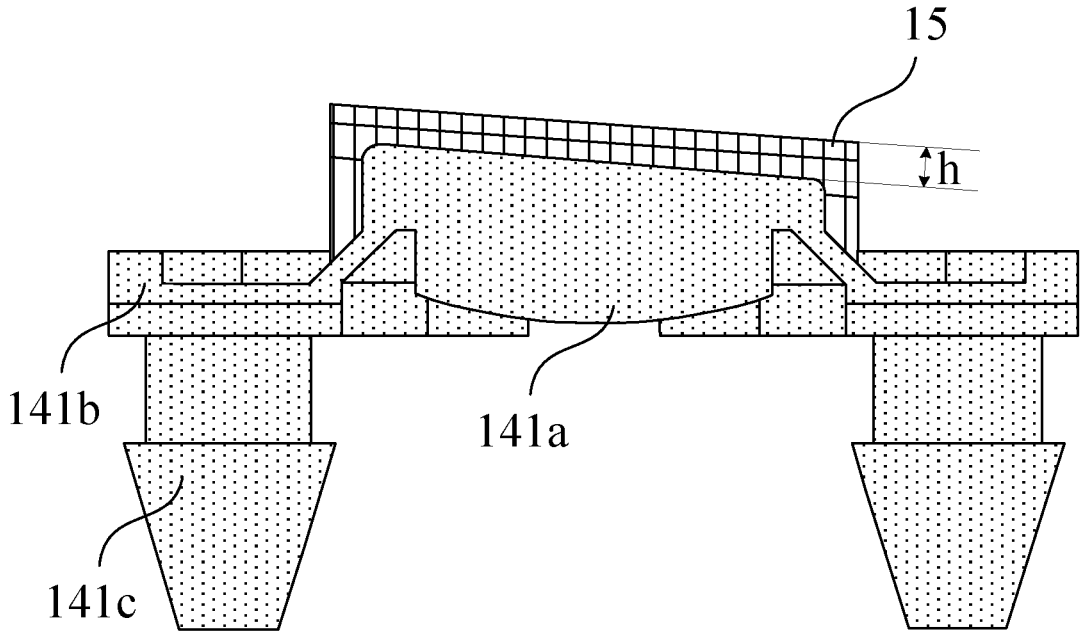
FIG. 8 shows a schematic side sectional view of another pressure detection device and flexible support structure according to the present disclosure.

As shown in FIG. 8, this embodiment provides a keybed device 1, which differs from embodiment 1 in that the bottom surface of the pressure detection device 14 is a curved surface.

Specifically, the top surface of the sensing component 141*a* is a flat surface (FIG. 8 shows the effect after being pressed by the key height limiting column 13, the top surface is an inclined surface), the bottom surface of the sensing component 141*a* is a curved surface, and the lowest point of the curved surface is located at the center of the bottom surface of the sensing component 141*a*.

The working principle of the keybed device 1 of this embodiment is as follows:

When a key is pressed, the first trigger member 161 and the second trigger member 162 are first triggered, and the key scanning circuit 17 determines the effective triggering and triggering strength of the key according to the triggering and triggering time of the two corresponding switches. As the key continues to be pressed down, when the key height limiting column 13 touches the flexible support structure 15, the player perceives that the key is pressed down and pauses. If the key continues to be pressed down, it means to start Aftertouch. The pressure sensing unit 141 is deformed as the height limiting column 13 is pressed down. When the bottom surface of the sensing component 141*a* in the pressure sensing unit 141 contacts the piezoresistor sensor 142, the two electrodes in the piezoresistor sensor 142 are conducted through the bottom surface of the sensing component 141*a* to generate an electrical signal, thereby triggering the Aftertouch effect. As the key height limiting column 13 continues to be pressed down, the contact area between the bottom surface of the sensing component 141*a* and the piezoresistor sensor 142 gradually increases. The resistance of the two electrodes in the piezoresistor sensor 142 is gradually reduced, and the resistance change between the two electrodes is converted into a voltage change through a processing circuit (the voltage change curve can be sampled by a high-speed ADC). After further processing, the Aftertouch information after each key is pressed can be obtained. Similarly, since the relative height of the flexible support structure 15 and the pressure sensing unit 141 is constant, the Aftertouch effects of the keys are also consistent.

The keybed device 1 of this embodiment realizes that the contact area between the sensing component 141*a* and the piezoresistor sensor 142 changes from small to large through the curvature of the lower surface of the sensing component 141*a*, so that the resistance between two electrodes changes from large to small, thereby increasing the dynamic range of resistance change.

Embodiment 3

As shown in FIGS. 9-19, this embodiment provides a keybed device 1, which differs from embodiment 1 in that the pressure sensing unit 141 includes a top recess 19 and an exhaust slot, the flexible support structure 15 includes a groove, and the flexible support structure 15 includes a reinforcing rib 22.

Figure 11:
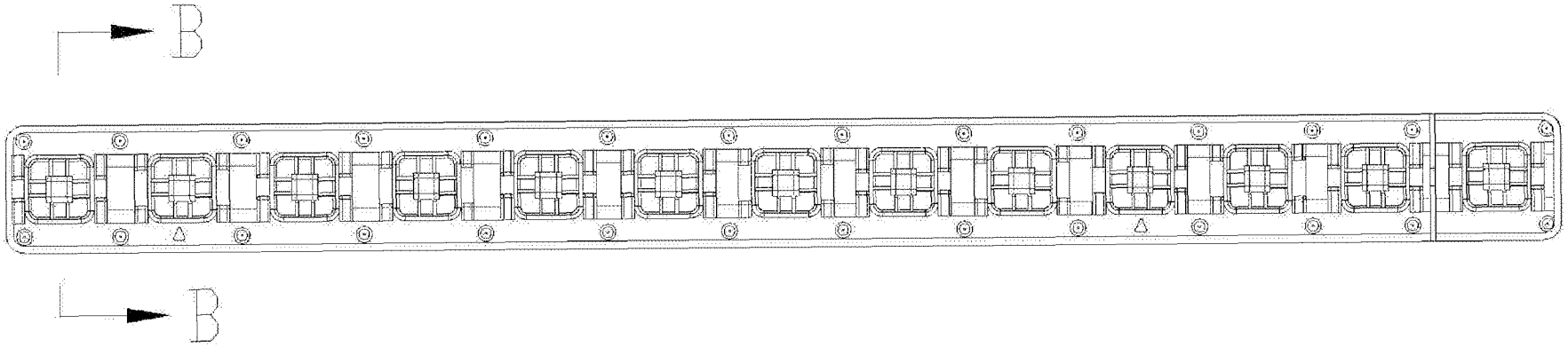
FIG. 11 shows a top view of another pressure detection device and flexible support structure according to the present disclosure.
Figure 15:
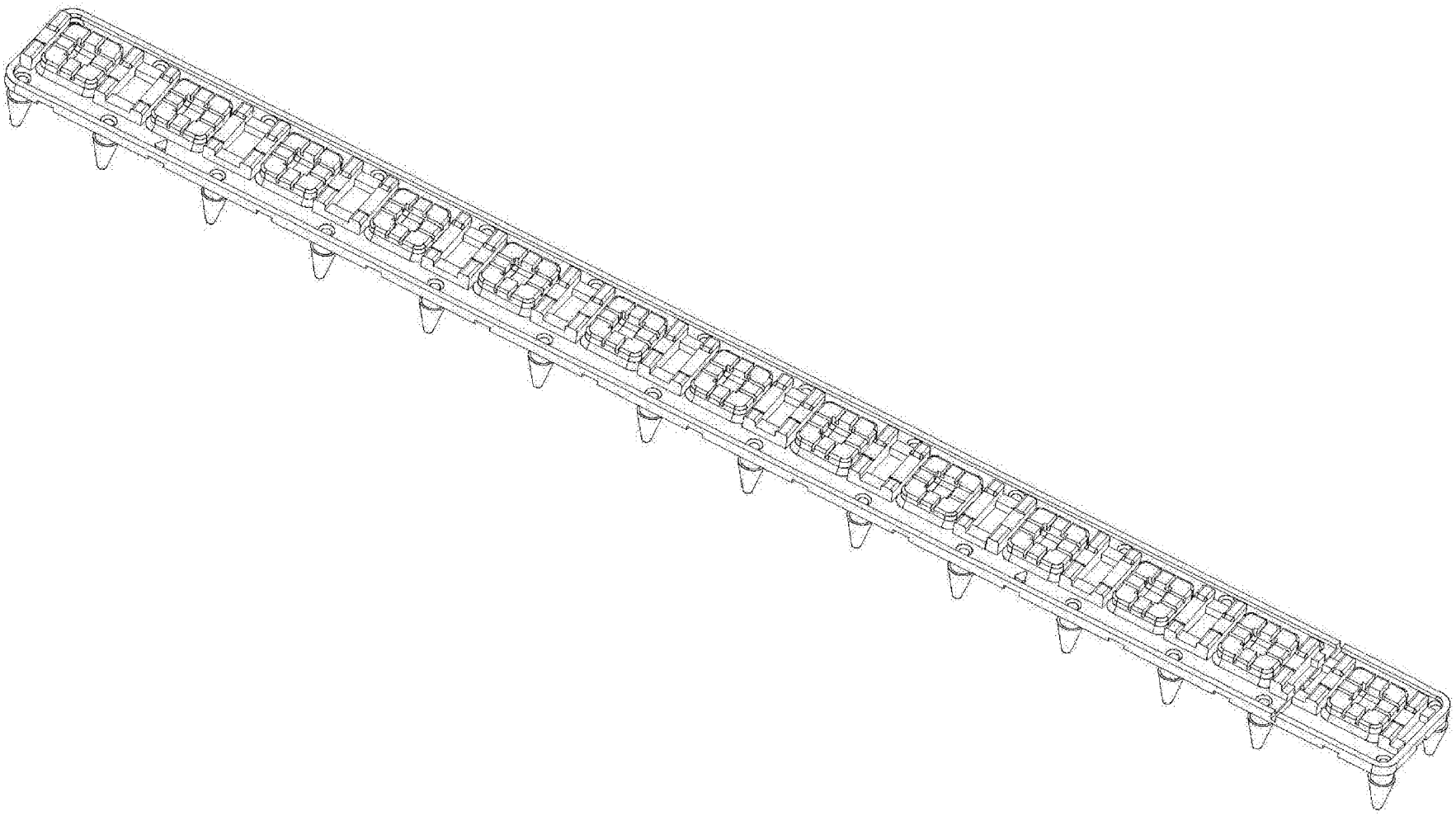
FIG. 15 shows a top perspective view of another pressure detection device and flexible support structure according to the present disclosure.
Figure 16:
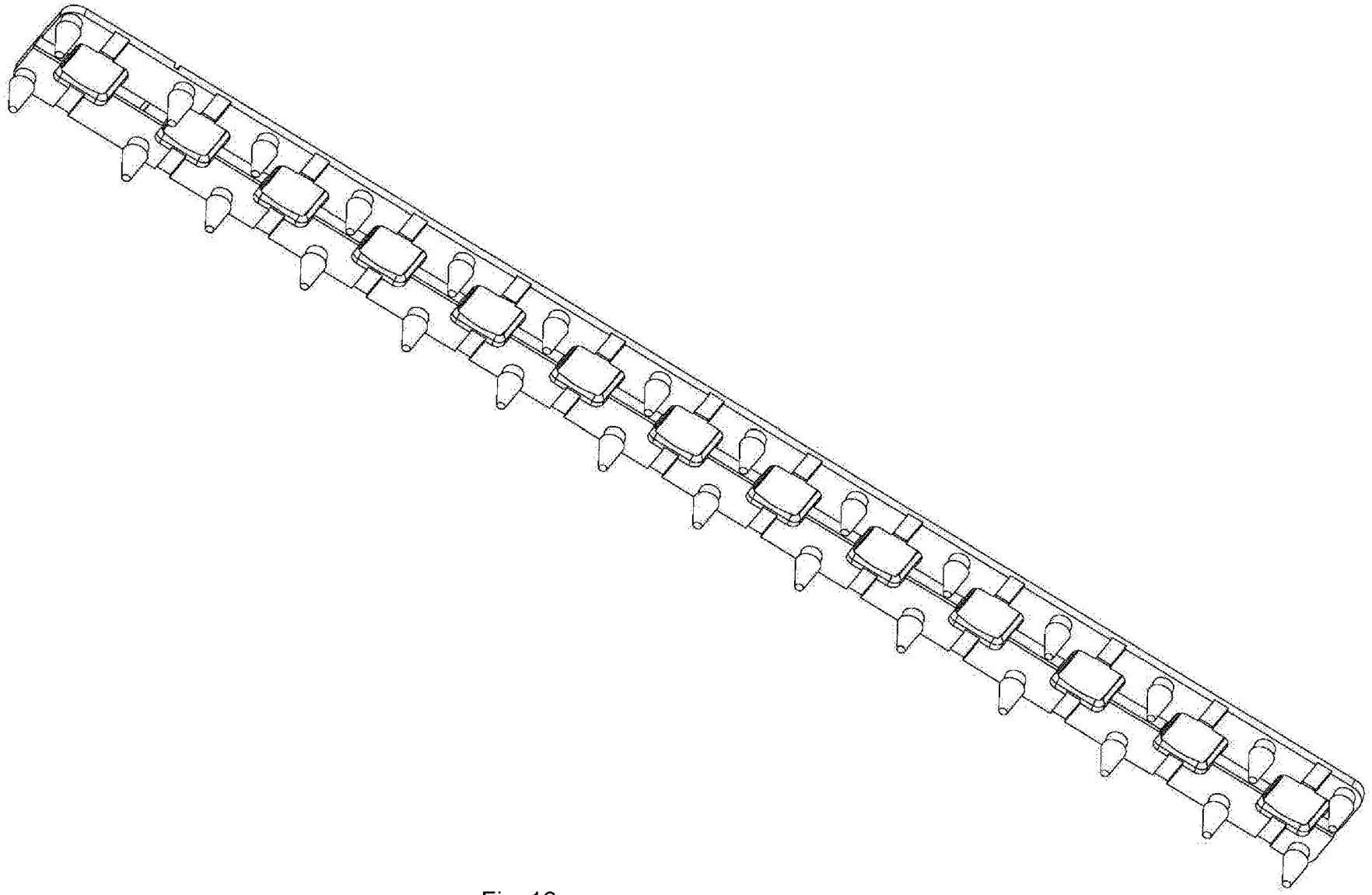
FIG. 16 shows a bottom perspective view of another pressure detection device and flexible support structure according to the present disclosure.
Figure 18:
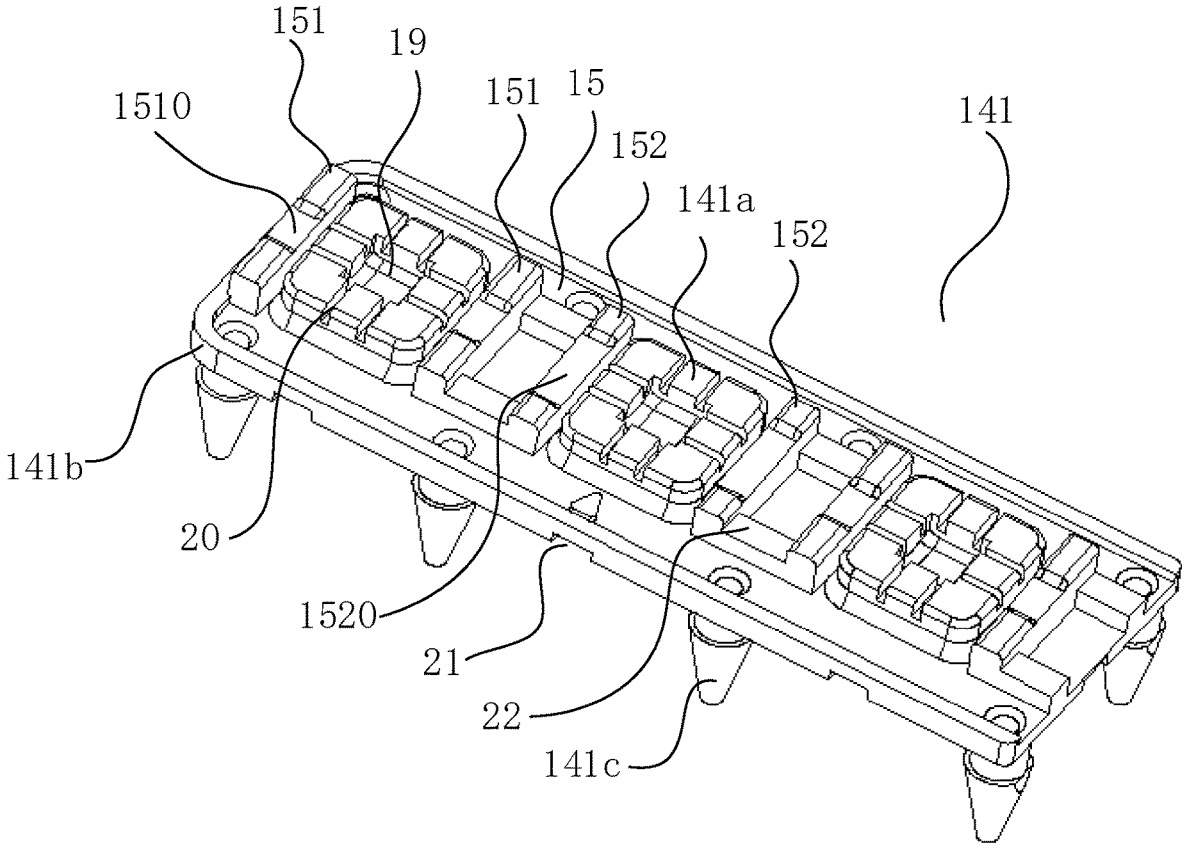
FIG. 18 shows a partial enlarged view of FIG. 15.

Specifically, as shown in FIGS. 11, 15 and 18, the sensing component 141*a* includes a top recess 19 and a first exhaust slot 20. The top recess 19 is formed in the top surface of the sensing component 141*a*, preferably, located at the center of the top surface of the sensing component 141*a*. The first exhaust slot 20 is formed in the top surface of the sensing component 141*a*, located around the top concave recess 19, and extending from the top concave recess 19 to a side surface of the sensing component 141*a*. This structure can prevent that the air between the key and the pressure sensing unit 141 is evacuated when the key is strongly pressed and released and the key is sucked by the pressure sensing unit 141 and cannot be quickly returned. At the same time, it can effectively improve the sensitivity of Aftertouch and the bottoming feel, making the performance of Aftertouch richer, and avoiding the noise generated by hard bottoming.

As an implementation of this embodiment, the first exhaust slot 20 extends in a direction perpendicular to the side surface of the sensing component 141*a*. The first exhaust slot 20 may also extend to the side surface of the sensing component 141*a* along other directions. Preferably, the top recess 19 has a square shape, and the side surfaces of the top recess 19 are respectively parallel or perpendicular to the side surface of the sensing component 141*a*. The sensing component 141*a* includes two first exhaust slots 20 corresponding to each edge of the square. This structure makes the exhaust slots evenly distributed. The exhaust slots combined with the top recess 19 in the middle of the sensing component 141*a* can maintain air circulation to the greatest extent, and prevent the key from being sucked by the sensing component 141*a*, thereby making the playing process smooth and preventing noise.

Figure 9:
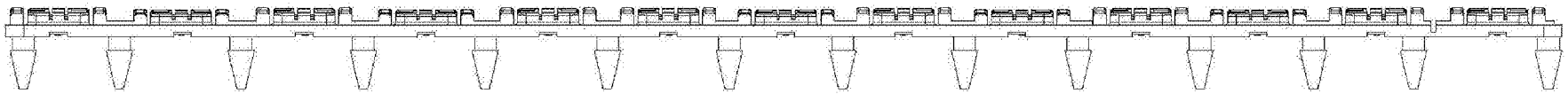
FIG. 9 shows a front view of another pressure detection device and flexible support structure according to the present disclosure.
Figure 10:
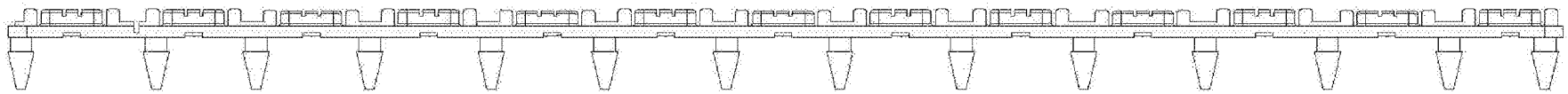
FIG. 10 shows a back view of another pressure detection device and flexible support structure according to the present disclosure.
Figure 12:
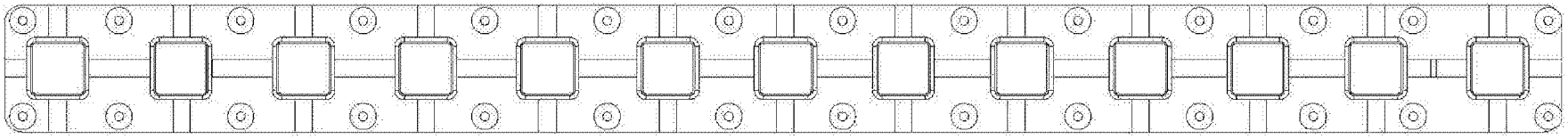
FIG. 12 shows a bottom view of another pressure detection device and flexible support structure according to the present disclosure.
Figure 13:
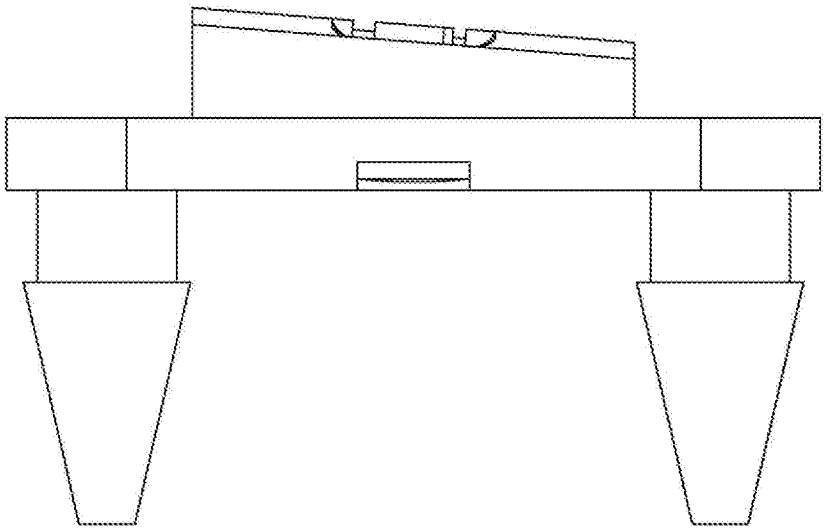
FIG. 13 shows a left side view of another pressure detection device and flexible support structure according to the present disclosure.
Figure 14:
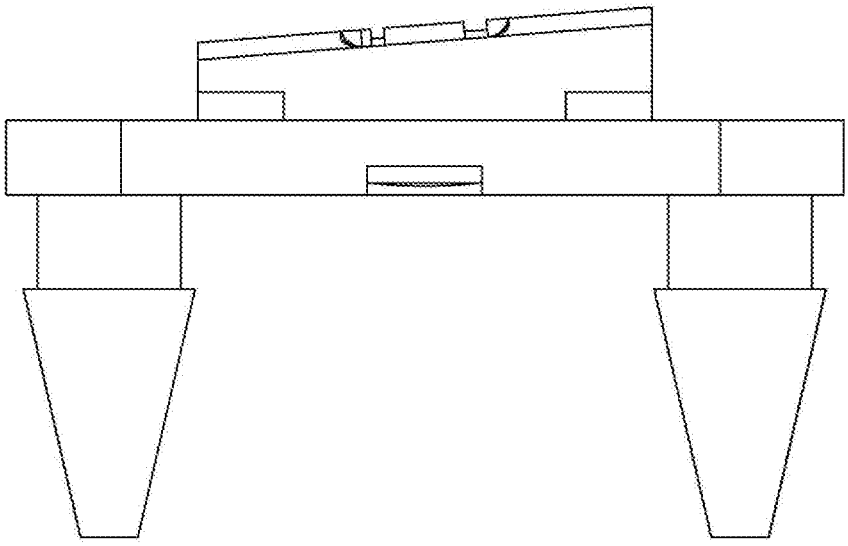
FIG. 14 shows a right side view of another pressure detection device and flexible support structure according to the present disclosure.
Figure 17:
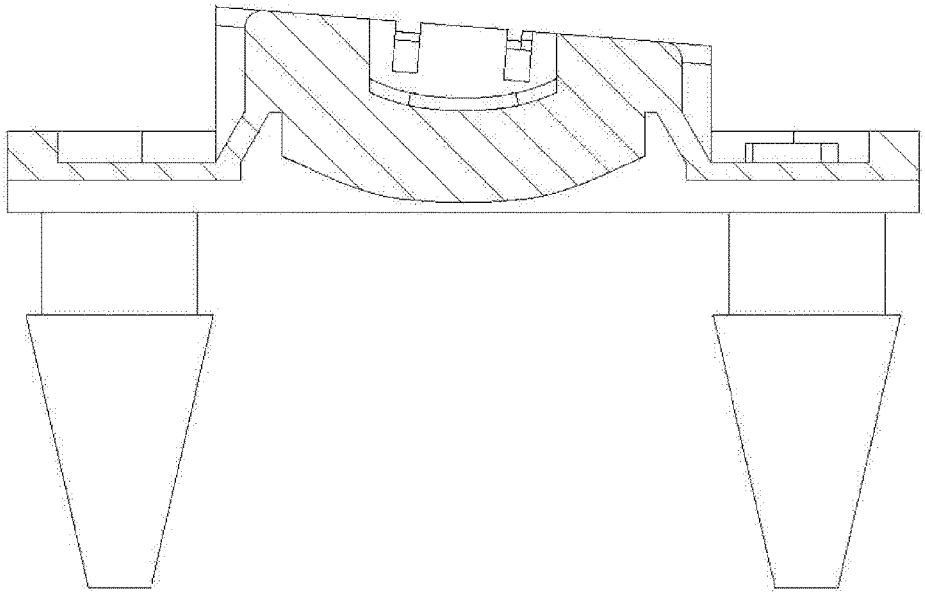
FIG. 17 shows a cross-sectional view in the direction of B-B in FIG. 11.
Figure 19:
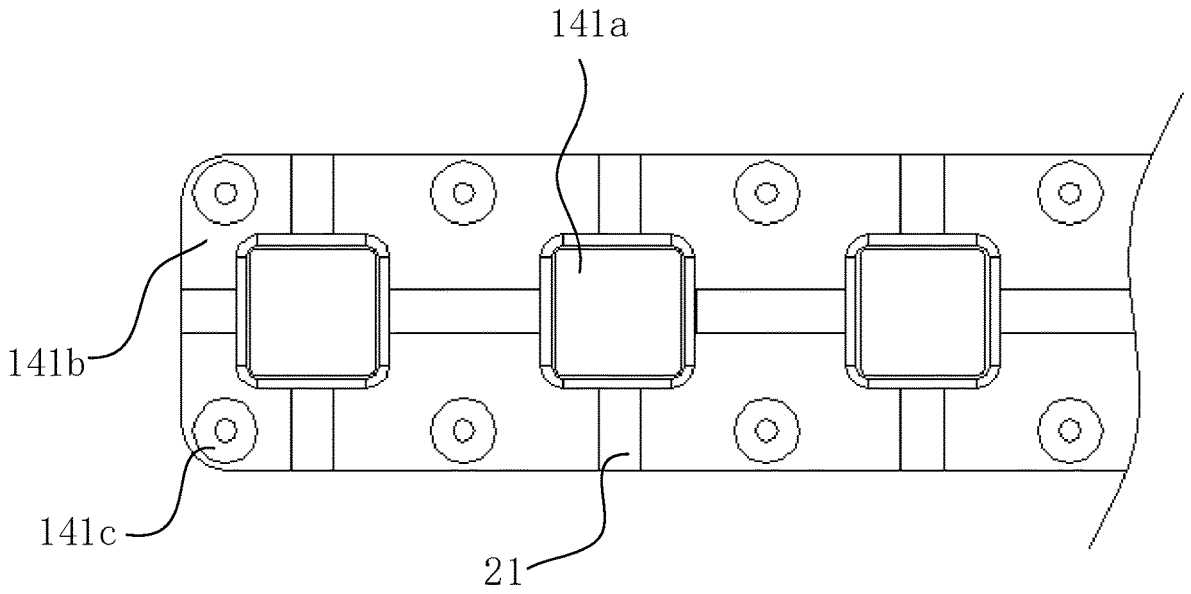
FIG. 19 shows a partial enlarged view of FIG. 12.

As shown in FIGS. 12, 17 and 19, the connecting component 141*b* includes a second exhaust slot 21. The second exhaust slot 21 is formed on a bottom surface of the connecting component 141*b*, and extends from the sensing component 141*a* to a side surface of the connecting component 141*b* or connects two adjacent sensing components 141*a* to form a cross connecting structure. The second exhaust slot 21 can prevent the air between the sensing component 141*a* and the piezoresistor sensor 142 at the bottom from being evacuated after the key is pressed, and cannot rebound quickly. Preferably, as shown in FIGS. 9 and 10, the width of the second exhaust slot 21 is longer than the width of the first exhaust slot 20.

As shown in FIG. 18, the flexible support structure includes white key support bars 151 and black key support bars 152. The white key support bars 151 are respectively arranged on both sides of the pressure detection device corresponding to the white keys in the keybed for supporting the white keys, and the black key support bars 152 are respectively arranged on both sides of the pressure detection device corresponding to the black keys in the keybed for supporting the black keys in the keybed. Since the white keys and the black keys are arranged alternately, a white key support bar 151 and a black key support bar 152 that are adjacent are arranged between two adjacent pressure detection devices.

As an implementation of this embodiment, the flexible support structure further includes a reinforcing rib 22 arranged between adjacent white key support bar 151 and black key support bar 152 to connect the white key support bar 151 with the black key support bar 152. The reinforcing rib 22 prevents the white key support bar 151 and the black key support bar 152 on both sides of the pressure sensing unit 141 from being overwhelmed when the key is strongly pressed against the pressure sensing unit 141.

As an implementation of this embodiment, the white key support bar 151 includes a first groove 1510, and the black key support bar 152 includes a second groove 1520. The length of the second groove 1520 is longer than the length of the first groove 1510, so that the supporting part corresponding to the white key is longer than the supporting part corresponding to the black key. That is, the arm of the white key is longer than that of the black key. In this case, the white keys and the black keys trigger Aftertouch under the same pressure, so as to adjust the trigger strength of Aftertouch, so that the Aftertouch can be triggered with light pressure during the playing process.

The keybed device of the present disclosure improves the Aftertouch pressure and Aftertouch effect of the keys, so that the Aftertouch pressure and Aftertouch effect obtained after different keys are pressed at the same depth are consistent, and the Aftertouch performance of the entire keybed is consistent.

In summary, the present disclosure proposes a keybed device, including: a keybed support; a keybed arranged on the keybed support; a key height limiting column arranged in one-to-one correspondence with each key in the keybed, and an end of the key height limiting column is fixed on a bottom surface of the corresponding key; a pressure detecting device arranged in one-to-one correspondence under each key height limiting column to detect a pressing strength of each key height limiting column; and a flexible support structure arranged below each key height limiting column and located on at least one side of each pressure detection device, and the flexible support structure includes a flexible material. The keybed device of the present disclosure includes a flexible support structure, which can avoid false triggering of the Aftertouch effect. A same depth is pressed down from the flexible support structure to obtain a consistent Aftertouch effect, and the performance effect is controllable. In addition, the keybed device of the present disclosure adopts a piezoresistor sensor to detect Aftertouch and Aftertouch strength, and the cost is low. Therefore, the present disclosure effectively overcomes various shortcomings in the existing technology and has high industrial utilization value.

The above-mentioned embodiments are just used for exemplarily describing the principle and effects of the present disclosure instead of limiting the present disclosure. Those skilled can make modifications or changes to the above-mentioned embodiments without going against the spirit and the range of the present disclosure. Therefore, all equivalent modifications or changes made by those who have common knowledge in the art without departing from the spirit and technical concept disclosed by the present disclosure shall be still covered by the claims of the present disclosure.

We claim:

1. A keybed device, at least comprising:

a keybed support;

a keybed arranged on the keybed support;

a key height limiting column arranged in one-to-one correspondence with each key in the keybed, and an end of the key height limiting column is fixed on a bottom surface of the corresponding key;

a pressure detecting device arranged in one-to-one correspondence under each key height limiting column to detect a pressing strength of each key height limiting column; and a flexible support structure arranged below each key height limiting column and located on at least one side of each pressure detection device.

2. The keybed device according to claim 1, wherein the pressure detection device includes a pressure sensing unit and a piezoresistor sensor located below the pressure sensing unit.

3. The keybed device according to claim 2, wherein the pressure sensing unit includes a sensing component, a connecting component, and a sensor fixing component; the connecting component is arranged on a side surface of the sensing component, and the sensor fixing component is arranged on a bottom surface of the connecting component to fix the piezoresistive sensor.

4. The keybed device according to claim 3, wherein the sensing component comprises:

a top recess formed in a top surface of the sensing component; and a first exhaust slot formed in the top surface of the sensing component and extending from the top recess to a side surface of the sensing component.

5. The keybed device according to claim 4, wherein the first exhaust slot extends in a direction perpendicular to the side surface of the sensing component.

6. The keybed device according to claim 4, wherein a shape of the top recess includes a square, and the sensing component includes two first exhaust slots corresponding to each edge of the square.

7. The keybed device according to claim 3, wherein the connecting component comprises:

a second exhaust slot formed on a bottom surface of the connecting component, which extends from the sensing component to a side surface of the connecting component or connects two adjacent sensing components.

8. The keybed device according to claim 2, wherein a lower surface of the pressure sensing unit is a curved surface.

9. The keybed device according to claim 2, wherein a material of the pressure sensing unit includes conductive silica gel or a flexible material coated with a conductive film on a lower surface.

10. The keybed device according to claim 2, wherein the piezoresistor sensor comprises a first electrode and a second electrode insulated from each other, and the first electrode and the second electrode form an interdigital structure.

11. The keybed device according to claim 1, wherein the flexible support structure comprises:

white key support bars respectively arranged on both sides of the pressure detection device corresponding to white keys in the keybed for supporting the white keys; and black key support bars respectively arranged on both sides of the pressure detection device corresponding to black keys in the keybed for supporting the black keys.

12. The keybed device according to claim 11, wherein a first groove is arranged on a top surface of the white key support bar, and a second groove is arranged on a top surface of the black key support bar.

13. The keybed device according to claim 12, wherein a length of the second groove is longer than a length of the first groove.

14. The keybed device according to claim 11, wherein the flexible support structure further includes a reinforcing rib arranged between adjacent white key support bar and black key support bar to connect the white key support bar with the black key support bar.

15. The keybed device according to claim 3, wherein a top surface of the flexible support structure is not lower than a top surface of the sensing component.

16. The keybed device according to claim 15, wherein a height difference between the top surface of the flexible support structure and the top surface of the sensing component is 0.3 mm.

* * * * *